US009119516B2

(12) United States Patent
Mayer et al.

(10) Patent No.: US 9,119,516 B2
(45) Date of Patent: Sep. 1, 2015

(54) DEVICE AND METHOD FOR ADJUSTING THE PRESSURE BETWEEN A FLOOR CLEANING IMPLEMENT AND A FLOOR

(75) Inventors: Heinrich-Tito Mayer, Jonschwil (CH); Franz Oberhaensli, Mosnang (CH)

(73) Assignee: Diversey, Inc., Sturtevant, WI (US)

( * ) Notice: Subject to any disclaimer, the term of this patent is extended or adjusted under 35 U.S.C. 154(b) by 1991 days.

(21) Appl. No.: 12/161,892

(22) PCT Filed: Jan. 25, 2007

(86) PCT No.: PCT/US2007/061044

§ 371 (c)(1),
(2), (4) Date: Jul. 23, 2008

(87) PCT Pub. No.: WO2007/086417

PCT Pub. Date: Aug. 2, 2007

(65) Prior Publication Data

US 2009/0056046 A1 Mar. 5, 2009

Related U.S. Application Data

(60) Provisional application No. 60/761,935, filed on Jan. 25, 2006.

(51) Int. Cl.

| | |
|---|---|
| ***A47L 11/40*** | (2006.01) |
| ***A47L 11/16*** | (2006.01) |
| ***A47L 11/283*** | (2006.01) |

(52) U.S. Cl.

CPC ..... *A47L 11/16* (2013.01); *A47L 11/283* (2013.01); *A47L 11/4055* (2013.01)

(58) Field of Classification Search

USPC ..... 15/50.3, 50.1, 50.2, 49.1, 340.4

See application file for complete search history.

(56) References Cited

U.S. PATENT DOCUMENTS

| | | | | |
|---|---|---|---|---|
| 4,674,142 | A * | 6/1987 | Meili | 15/49.1 |
| 4,679,271 | A * | 7/1987 | Field et al. | 15/52.1 |

(Continued)

FOREIGN PATENT DOCUMENTS

| | | |
|---|---|---|
| EP | 0173394 | 3/1986 |
| EP | 1600095 | 11/2005 |

(Continued)

OTHER PUBLICATIONS

The International Search Report from the European Patent Office.

(Continued)

*Primary Examiner* — Dung Van Nguyen

(74) *Attorney, Agent, or Firm* — Michael Best & Friedrich LLP

(57) ABSTRACT

A device and method for regulating the pressure between a floor cleaning implement (22) and a floor, wherein the floor cleaning implement (22) is coupled to a floor cleaning machine (10). The device of one embodiment comprises a cantilevered arm (28) coupled to the floor cleaning machine (10) and a sensor (30) coupled to the cantilevered arm (28) and positioned to sense deflection or other deformation of the cantilevered arm (28). An actuator (26) is coupled between the cantilevered arm (28) and cleaning implements (22). The actuator (26) is also coupled to the sensor (30) and adapted to receive signals from the sensor (30) to cause actuation of the actuator (26). When pressure other than a predetermined amount causes the cantilevered arm (28) to deform, the sensor (30) senses this deformation and cause the actuator (26) to actuate in a direction that allows the cantilevered arm (28) to return to a position in which the pressure is within the predetermined amount.

8 Claims, 7 Drawing Sheets

(56) References Cited

U.S. PATENT DOCUMENTS

| | | | | |
|---|---|---|---|---|
| 4,757,566 | A | | 7/1988 | Field et al. |
| 6,163,915 | A | | 12/2000 | Kaczmarz et al. |
| RE39,581 | E | * | 4/2007 | Stuchlik et al. ..... 15/49.1 |
| RE41,036 | E | * | 12/2009 | Bushey et al. ..... 318/135 |

FOREIGN PATENT DOCUMENTS

| | | |
|---|---|---|
| JP | H05-228090 | 9/1993 |
| JP | H07-059702 | 3/1995 |
| JP | H07-088453 | 4/1995 |
| JP | 2000-517228 | 12/2000 |
| JP | 2005-303196 | 10/2005 |
| WO | 95/13737 | 5/1995 |
| WO | 97/08984 | 3/1997 |

OTHER PUBLICATIONS

The Notification of Reason for Rejection prepared by the Japanese Patent Office—Issue Date—May 31, 2011.

* cited by examiner

DEVICE AND METHOD FOR ADJUSTING THE PRESSURE BETWEEN A FLOOR CLEANING IMPLEMENT AND A FLOOR

BACKGROUND OF THE INVENTION

The present invention relates to a device for adjusting the pressure between a floor cleaning implement of a floor cleaning machine and a floor. The floor cleaning machine can be one of many types of floor cleaning and treating machines, such as scrubbers, sweepers, and the like. These types of machines can be used for the cleaning of hard surfaces of large floor areas in hotels, factories, office buildings, shopping centers and the like.

In general such machines comprise a movable body supported by a pair of drive wheels and one or more caster wheels. With a scrubber, the body carries a scrubbing device, reservoirs for storing fresh and spent cleaning liquid, a device for dosing fresh cleaning liquid onto the floor, and a squeegee/vacuum pickup system for recovering spent cleaning liquid from the floor.

The scrubbing device normally comprises one or more brushes or scrubbing pads, a motor for driving the brushes, and a device for lifting the brushes off the floor when large areas are traversed without any cleaning action being required.

A typical conventional floor cleaning machine has the problem in that a force for pressing the pad against the floor-surface is changed during operation, due to various causes such as wear of the pad, reduced voltage of the batteries, state of the floor-surface, and the like, and as a result, the quality level of the polishing job for the floor-surface is changed. If the pad pressure is too strong, there is a possibility that the wax applied to the floor-surface comes off and the floor-surface may be scratched. In contrast, if the pad pressure is too weak, a sufficient polishing effect can not be obtained.

Conventional devices regulate brush/pad pressure many different ways. For example, some devices monitor the current within the scrubbing motors to determine the brush pressure and adjust the brush pressure actuating the lifting device for the scrubbing assembly.

The present invention has been designed to overcome some of the complications and/or problems inherent in the conventional devices.

SUMMARY OF THE INVENTION

The present invention relates to a cleaning implement pressure regulating system for a floor cleaning machine.

One particular embodiment of the present invention provides a floor cleaning machine comprising a motor-driven movable body carrying a cleaning implement assembly which comprises a housing having one or more cleaning implements coupled to the housing. A motor is coupled to the housing and the cleaning implements for driving the cleaning implements. An actuator, such as linear motor, is coupled to the housing for lifting and lowering the housing. An elastically deformable cantilevered arm is coupled to the body and the actuator. A sensor is coupled to the cantilevered arm to sense or measure deformation of the cantilevered arm. A controller is coupled to the sensor and the actuator. The controller actuates the actuator in response to signals from the sensor indicating deformation of the cantilevered arm. Actuation of the actuator adjusts the pressure of the cleaning implements against a floor.

Another embodiment is directed toward a device for regulating the pressure between a floor cleaning implement and a floor, wherein the floor cleaning implement is coupled to a floor cleaning machine. The device comprises a cantilevered arm coupled to the floor cleaning machine and a sensor coupled to the cantilevered arm and positioned to sense deflection or other deformation of the cantilevered arm. An actuator is coupled between the cantilevered arm and cleaning implements. The actuator is also coupled to the sensor and adapted to receive signals from the sensor to cause actuation of the actuator. When pressure other than a predetermined amount between the floor cleaning implement and the floor causes the cantilevered arm to deform, the sensor senses this deformation and cause the actuator to actuate in a direction that allows the cantilevered arm to return to a position in which the pressure is within the predetermined amount. In some embodiments, the allowable predetermined pressure is a range of pressures.

Another embodiment is directed toward a device for regulating the pressure between a floor cleaning implement and a floor, wherein the floor cleaning implement is coupled to a floor cleaning machine. The device includes a flexible cantilevered arm coupled between to the frame of the floor cleaning machine and the floor cleaning implements. The flexible cantilevered arm is adapted to elastically deform when the pressure between the floor cleaning implement and the floor is other than a predetermined amount. This deformation of the cantilevered arm returns the pressure between the floor cleaning implements and the floor to the predetermined amount.

Yet other embodiments are directed to a method of regulating pressure between a floor scrubbing implement and a floor.

Further aspects of the present invention, together with the organization and operation thereof, will become apparent from the following detailed description of the invention when taken in conjunction with the accompanying drawings.

DETAILED DESCRIPTION

Figure 1:
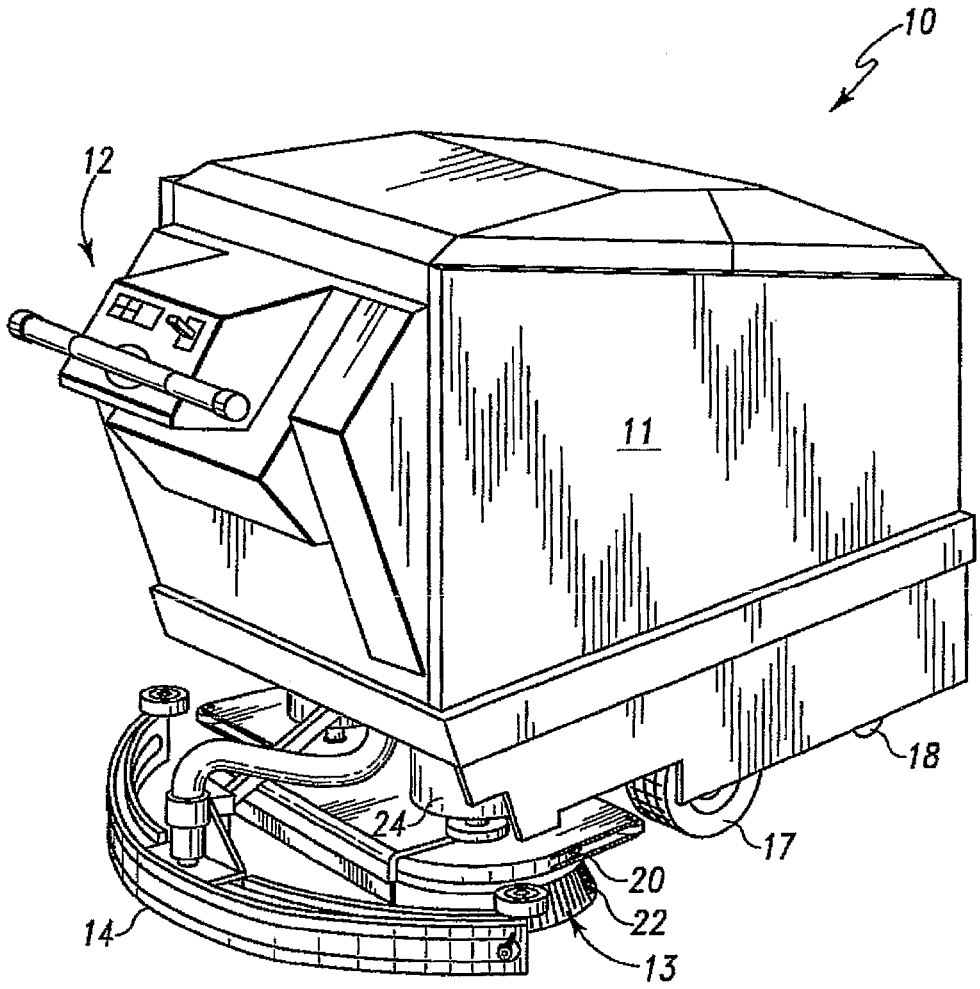
FIG. 1 is a perspective view of a floor scrubbing machine embodying aspects of the present invention.
Figure 2:
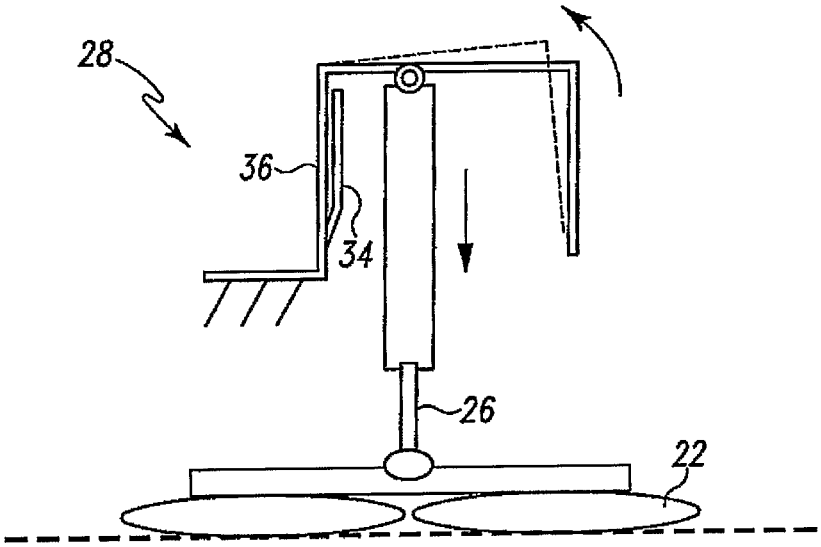
FIG. 2 is a schematic representation of a pressure regulation device embodying aspects of the present invention.
Figure 3:
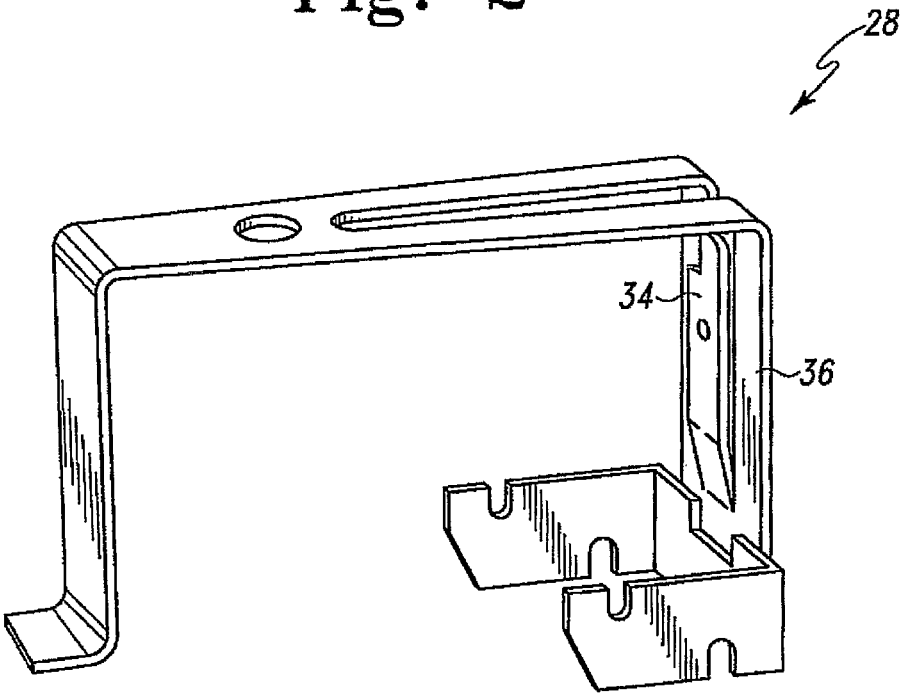
FIG. 3 is a perspective view of a cantilevered arm incorporated in one embodiment of the present invention.
Figure 4:
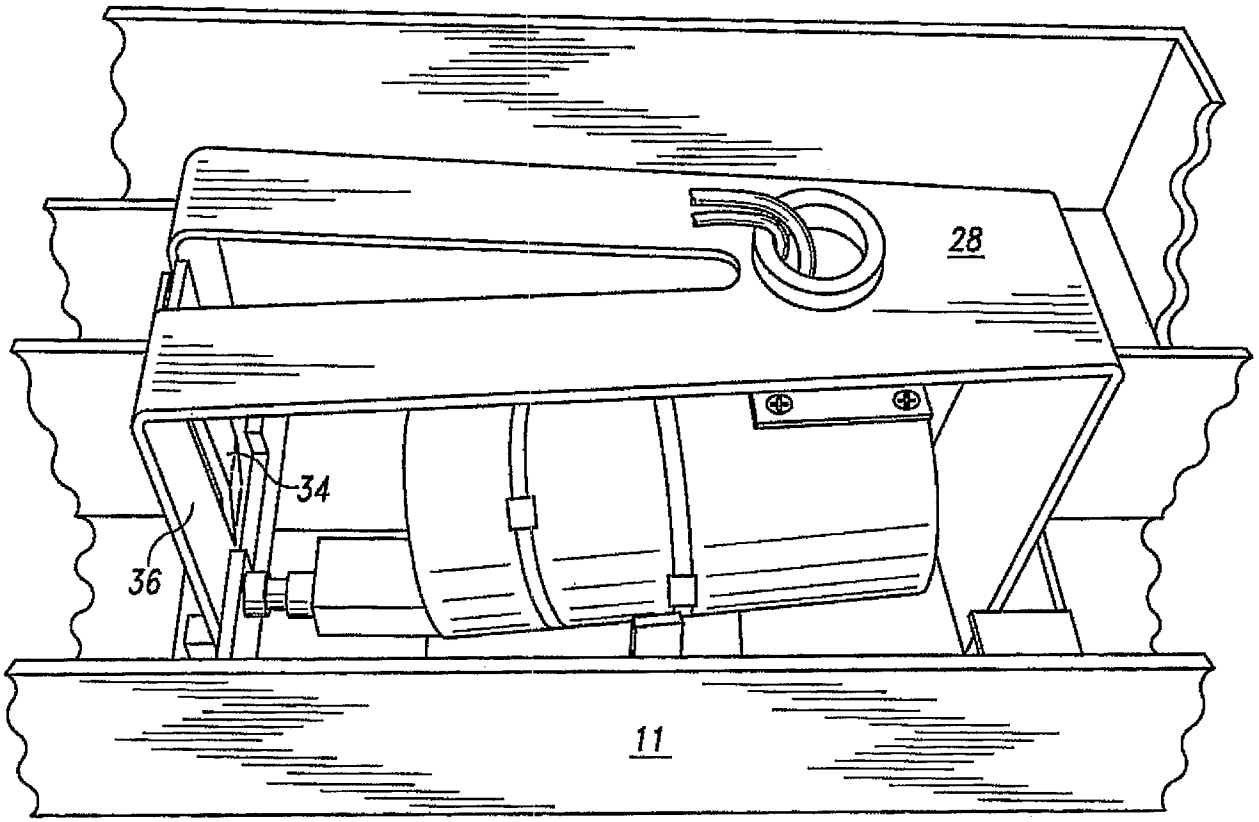
FIG. 4 is a perspective view of the cantilevered arm shown in FIG. 3, wherein the cantilevered arm is coupled to the frame of a floor cleaning machine and an actuator is coupled to the cantilevered arm.
Figure 5:
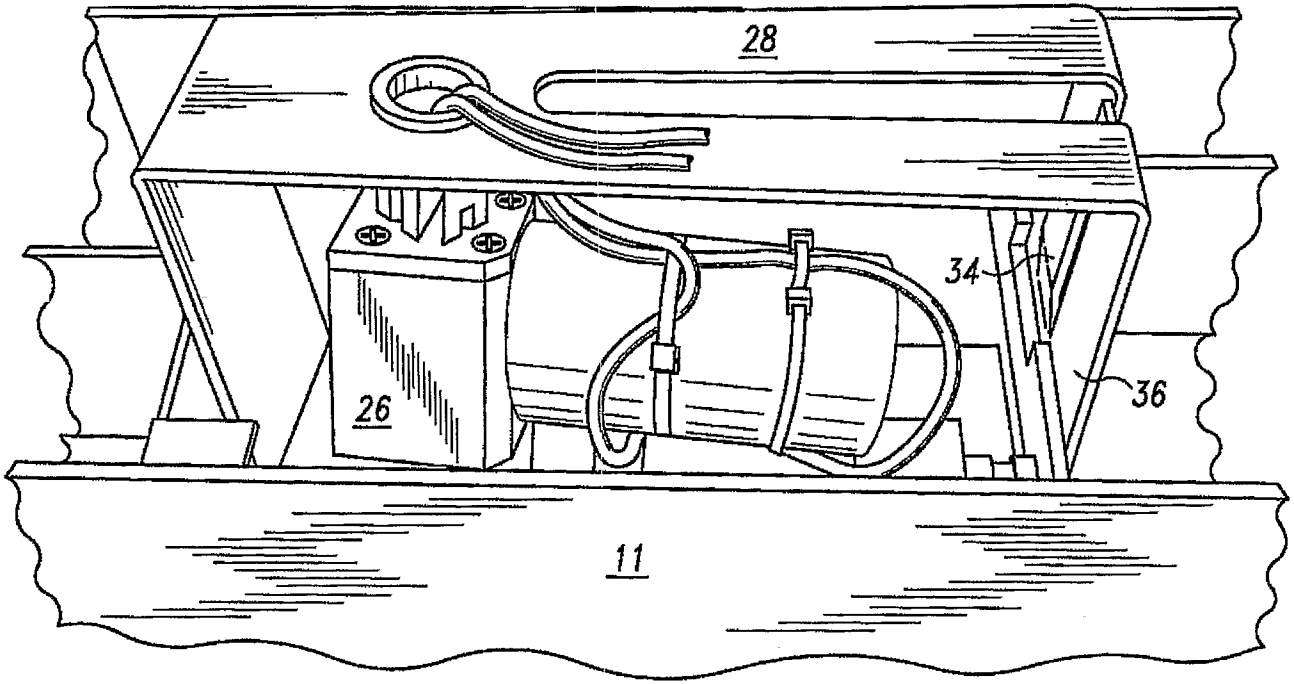
FIG. 5 is another perspective view of the cantilevered arm shown in FIG. 3, wherein the cantilevered arm is coupled to the frame of a floor cleaning machine and an actuator is coupled to the cantilevered arm.
Figure 6:
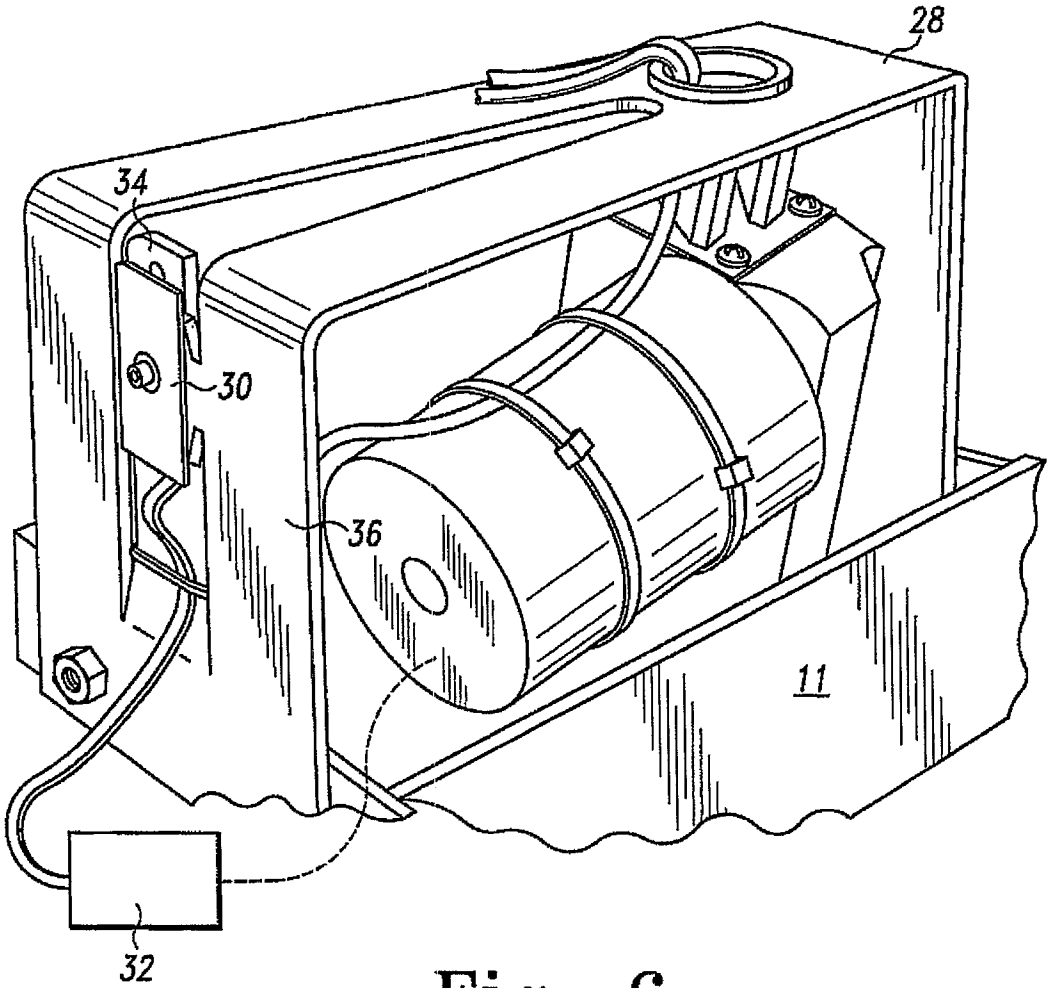
FIG. 6 is another perspective view of the cantilevered arm shown in FIG. 3, with this figure showing the sensor coupled to the cantilevered arm.
Figure 7:
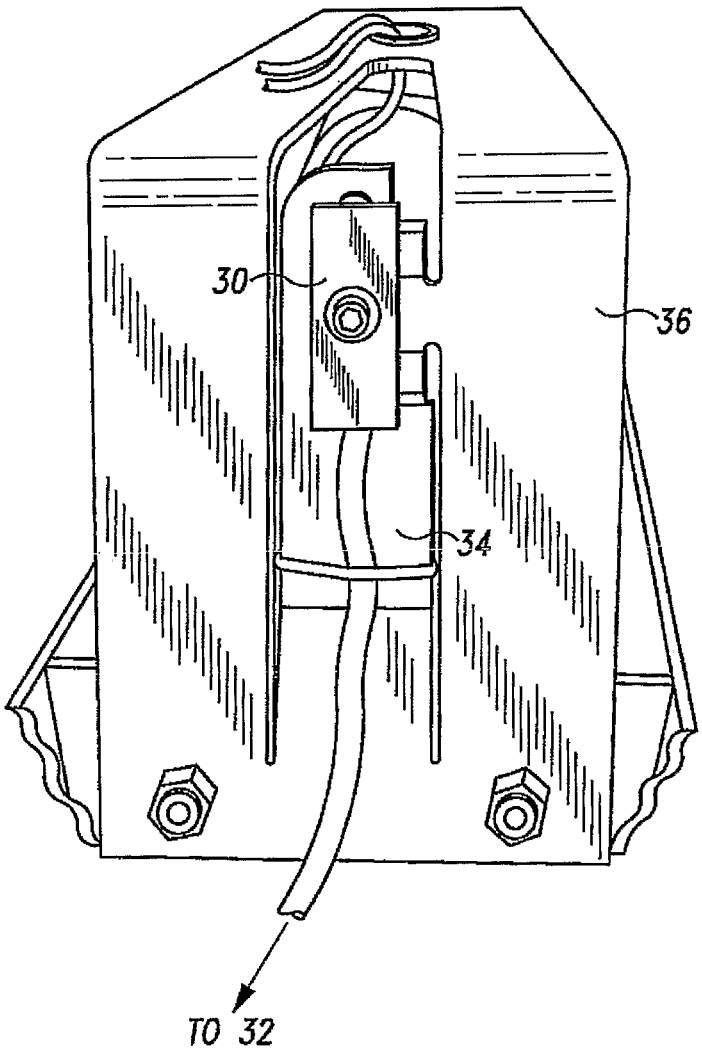
FIG. 7 is another perspective view of the cantilevered arm shown in FIG. 3, with this figure showing the sensor coupled to the cantilevered arm.
Figure 8:
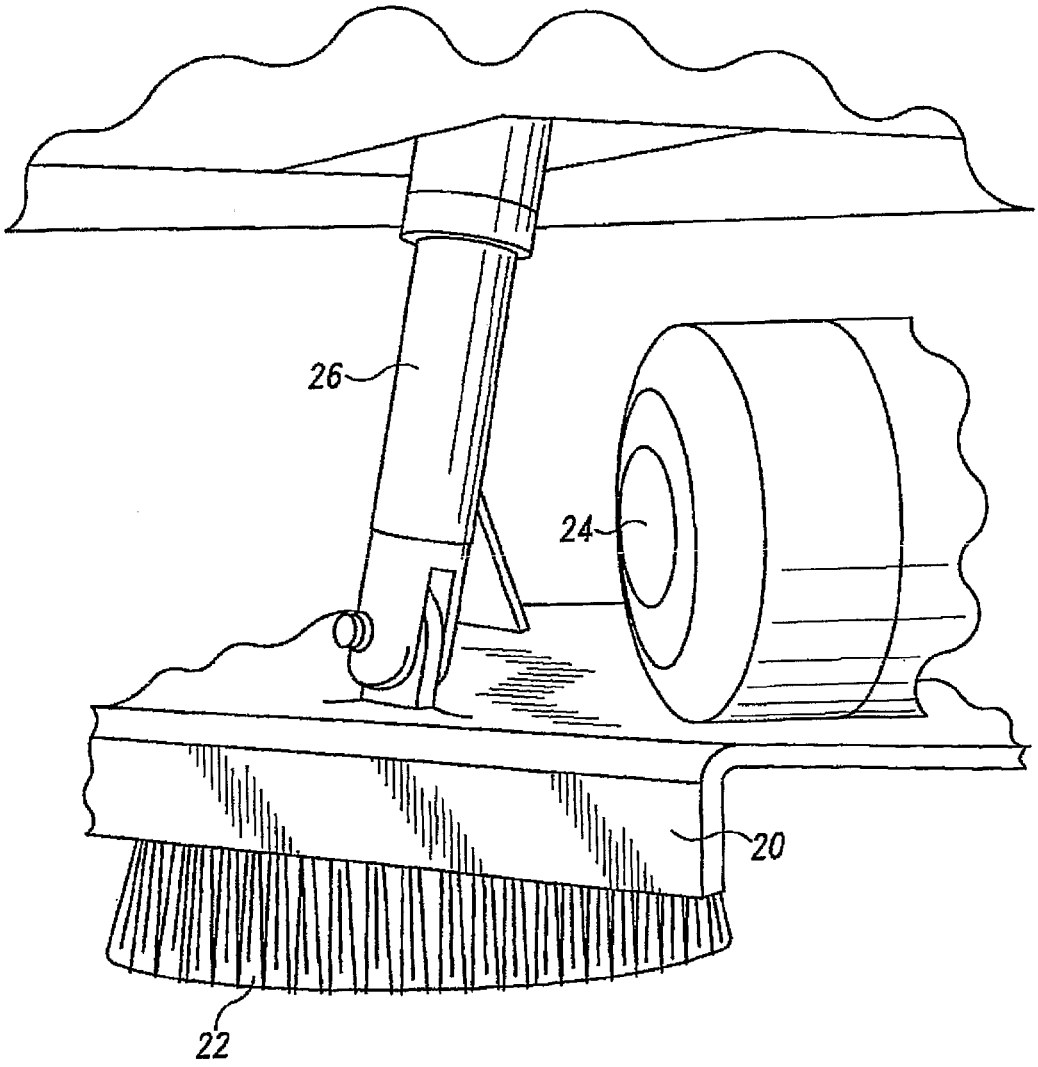
FIG. 8 is a perspective view of the actuator shown in FIGS. 4-7 coupled to the housing of a scrubbing assembly.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

Referring now to FIG. 1, a floor cleaning machine 10 is shown, comprising a housing 11, an operator control assembly 12, a scrubbing assembly 13 and a squeegee 14. The cleaning machine 10 is supported on main drive wheels 16 and one or more caster wheels 18. Although it is not illustrated, several items such as a tank, batteries, pumps, motors, and other parts can be housed within the housing 11.

Although one particular embodiment of the invention will be described in connection with a scrubber, it should be clear that the invention has application to other types of floor maintenance vehicles, such as sweepers and the like. Accordingly, the present invention should not be limited to a scrubber.

The scrubbing assembly 13 includes a head or housing 20 having one or more cleaning implements 22, such as rotating, orbiting, or reciprocating brushes or pads. A motor 24 is coupled to the housing 20 and the cleaning implements 22 to drive the cleaning implements 22 in a cleaning motion.

An actuator 26 is also coupled to the housing 20 to lift and lower the housing 20 and cleaning implements 22 relative to the floor. In the illustrated embodiment, a linear motor is used as the actuator 26. However, in other embodiments, other actuators 26 can be used, such as a motor having a rack and pinion gear assembly and the like. The actuator 26 can be used to lift the housing 20 and implements entirely off of the floor. Further, the actuator 26 can be used to place the implements 22 on the floor and adjust the pressure of the implements 22 on the floor.

The actuator 26 is coupled to a cantilevered arm 28, which is coupled to the body, frame, or housing of the floor cleaning machine 10. As illustrated, the cantilevered arm 28 has two ends. One end is coupled to the frame of the floor cleaning machine 10. The other end is cantilevered. In the illustrated embodiment, the cantilevered arm 28 is configured in a substantially C-shaped configuration. However, in other embodiments, the cantilevered arm 28 can have other configurations, such as more linear configurations, L-shaped configurations, and the like. Other devices, other than the actuator or linear motor can be coupled to the cantilevered arm 28, which can affect the shape of the cantilevered arm 28.

Due to the connection of the cantilevered arm 28 to the scrubbing assembly 13, increased pressure or force between the cleaning implements 22 and the floor (caused by imperfections in the floor for example) will cause a force to be applied to the cantilevered arm 28 via the actuator 26 extending between the cantilevered arm 28 and the scrubbing assembly 13. This force applied to the cantilevered arm 28 will cause the cantilevered arm 28 to bend or deform elastically. This elastic deformation can help to reduce undesirable levels of pressure between the cleaning implements 22 and the floor caused suddenly by imperfections in the floor. Once the imperfection is no longer in contact with the cleaning implements 22 (due to translation of the cleaning machine over the floor), the cantilevered arm 28 can return to a non-deflected or non-deformed condition (or to a normal deflection condition) due to elastic forces. As such, the originally desired pressure between the cleaning implements 22 and the floor can be restored.

In some situations, however, the change in pressure between the cleaning implements 22 and the floor may not be a temporary condition. In such situations, a sensor 30 that is coupled to the cantilevered arm 28 can sense or measure the deformation of the cantilevered arm 28 and cause the actuator 26 to actuate to change the pressure to the desired pressure, which can be a range of pressures. The sensor 30 can be any variety of deflection/deformation sensors. For example, a strain gauge can be used to measure or sense the deformation of the cantilevered arm, as well as Hall-effect sensors, load sensors, optical sensors, ultrasonic sensors, laser sensors, inductive sensors, capacitive sensors, and the like. In some embodiments, contact switches such as microswitches and the like can be used as well. In such embodiment, sufficient deformation can cause the arm to contact a switch.

In the illustrated embodiment, a hall-sensor is shown coupled to the cantilevered arm 28. Specifically, as shown, one portion of the sensor 30 is coupled to a portion 34 of the cantilevered arm 28 that is generally not stressed, strained, or otherwise deformed by forced applied to the cantilevered end of the arm during normal operation. A second portion 36 of the sensor 30 is coupled to a portion of the cantilevered arm 28 that is deformed by forced applied to the cantilevered end of the arm during operation. Accordingly, forces applied to the cantilevered arm during operation, will cause relative movement between the two portions of the sensor 30. As such, the forces applied to the cantilevered arm 28 can be determined.

In some embodiments, the sensor 30 is in communication with a controller 32, and the controller 32 is coupled to the actuator 26. Accordingly, the controller 32 can actuate the actuator 26 in response to signals from the sensor indicating deformation of the cantilevered arm 28. This actuation of the actuator 26 adjusts the pressure of the cleaning implements 22 against the floor.

In operation, the actuator 26 can be used to raise and lower the scrubbing or cleaning assembly 13 relative to the floor. For example, when the floor cleaning machine 10 is being transported from one cleaning location to another, the actuator 26 can be actuated to lift the cleaning assembly 13 off of the floor. Once the cleaning assembly 13 reaches a desired location, the actuator 26 can be actuated again to lower the cleaning assembly 13 into contact with the floor. Furthermore, the actuator 26 can continue to actuate to place the cleaning assembly 13 into proper contact with floor. In other words, the actuator 26 can place the cleaning assembly 13 into the desired pressure with the floor.

During operation, the scrubbing assembly 13 may contact imperfections or other variations in the floor surface. These imperfections or variations may cause a sudden increase in pressure between the cleaning implements 22 and the floor. As previously discussed, such sudden increases in pressure can cause damage to the floor if not promptly addressed. In some situations, the sudden increase in pressure is relieved by the deformation of the cantilevered arm 28. This situation may occur when the imperfection is small and quickly passed over by the floor cleaning machine. In such a situation, the cantilevered arm 28 would return to the non-deflected condition and the correct pressure would be achieved once the imperfection is passed.

In other situations, the imperfection may be so great, large, or prolonged that elastic deformation of the cantilevered arm 28 may not be sufficient to relieve the pressure. In such situations, the sensor 30 on the cantilevered arm 28 would sense the deflection of the cantilevered arm 28 and cause the actuator 26 to actuate, and thus, reduce the pressure.

In some situations, the change in pressure may be caused by wear and tear on the cleaning implements 22. In such situations, the cantilevered arm 28 may deform in the opposite direction due the pressure between the cleaning implements 22 and the floor being too low. Accordingly, the sensor 30 would sense a deflection or deformation of the arm 28 and cause the actuator 26 to actuate in a direction that would increase the pressure. The sensor 30 would sense when the pressure is correct and stop the actuator 26 from actuating. The sensor 30 would sense such a condition when the cantilevered arm 28 is stressed, deformed, or deflected a predetermined amount associated with the proper pressure or force.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A device for regulating the pressure between a floor cleaning implement and a floor, wherein the floor cleaning implement is coupled to a floor cleaning machine, the device comprising:

a cantilevered arm coupled to the floor cleaning machine;

a sensor coupled to the cantilevered arm and positioned to sense deflection or other deformation of the cantilevered arm, an actuator coupled between the cantilevered arm and cleaning implements, the actuator also coupled to the sensor and adapted to receive signals from the sensor to cause actuation of the actuator;

wherein pressure other than a predetermined amount between the floor cleaning implement and the floor causes the cantilevered arm to deform, the sensor senses this deformation and causes the actuator to actuate in a direction that allows the cantilevered arm to return to a position in which the pressure is within the predetermined amount.

2. The device of claim 1, wherein the predetermined pressure is a range of pressures.

3. The device of claim 1, wherein the pressure other than the predetermined pressure is a pressure greater than the predetermined pressure.

4. A device for regulating the pressure between a floor cleaning implement and a floor, wherein the floor cleaning implement is coupled to a floor cleaning machine, the device comprising:

a flexible cantilevered arm coupled between the frame of the floor cleaning machine and the floor cleaning implements, the flexible cantilevered arm adapted to elastically deform when the pressure between the floor cleaning implement and the floor is other than a predetermined amount, this deformation of the cantilevered arm returning the pressure between the floor cleaning implements and the floor to the predetermined amount.

5. A floor cleaning machine comprising:

a motor-driven movable body;

a cleaning implement assembly having a housing and one or more cleaning implements coupled to the housing;

a motor coupled to the housing and the cleaning implements for driving the cleaning implements;

an actuator coupled to the housing for lifting and lowering the housing;

an elastically deformable cantilevered arm coupled to the body and the actuator, the actuator coupled between the cleaning implements and the cantilevered arm;

a sensor coupled to the cantilevered arm to sense or measure deformation of the cantilevered arm; and a controller coupled to the sensor and the actuator, wherein the controller actuates the actuator in response to signals from the sensor indicating deformation of the cantilevered arm greater than a predetermined amount to maintain the cleaning implements in contact with a floor within a predetermined range of pressure determined by the deflection of the cantilevered arm.

6. The floor cleaning machine of claim 5, wherein the actuator is a linear motor.

7. A method for regulating the pressure between a floor cleaning implement and a floor, wherein the floor cleaning implement is coupled to a floor cleaning machine, the method comprising:

providing a cantilevered arm coupled to the floor cleaning machine and a sensor coupled to the cantilevered arm and positioned to sense deflection or other deformation of the cantilevered arm;

providing an actuator coupled between the cantilevered arm and cleaning implements, the actuator being coupled to the sensor and adapted to receive signals from the sensor to cause actuation of the actuator;

operating the floor cleaning machine;

sensing deformation of the cantilevered arm greater than a predetermined amount;

actuating the actuator in a direction that allows the cantilevered arm to return to a position in which the deformation of the cantilevered arm is less than the predetermined amount.

8. A method for regulating the pressure between a floor cleaning implement and a floor, wherein the floor cleaning implement is coupled to a floor cleaning machine, the method comprising:

providing a flexible cantilevered arm coupled between a frame of the floor cleaning machine and the floor cleaning implements;

operating the floor cleaning machine;

encountering a condition causing the pressure between the floor cleaning implement and the floor to be other than a predetermined amount; and elastically deforming the cantilevered arm in response to the condition to return the pressure between the floor cleaning implement and the floor to the predetermined amount.

* * * * *